United States Patent [19]

Olsson

[11] Patent Number: 4,624,220

[45] Date of Patent: Nov. 25, 1986

[54] INFRASOUND GENERATOR

[76] Inventor: Mats A. Olsson, Björkrisvägen 13, S-161 39 Bromma, Sweden

[21] Appl. No.: 799,290

[22] Filed: Nov. 20, 1985

Related U.S. Application Data

[63] Continuation of Ser. No. 712,007, Mar. 15, 1985, abandoned, which is a continuation-in-part of Ser. No. 649,957, Sep. 11, 1984, abandoned, which is a continuation of Ser. No. 588,050, Mar. 9, 1984, abandoned, which is a continuation of Ser. No. 457,071, Dec. 29, 1982, abandoned.

[30] Foreign Application Priority Data

Apr. 30, 1981 [SE] Sweden ..... 8102755

[51] Int. Cl.[4] ..... F22B 37/48; B08B 3/12; F28D 11/06

[52] U.S. Cl. ..... 122/379; 122/396; 165/84; 181/0.05; 134/1

[58] Field of Search ..... 122/379, 396, 392, 504; 134/1; 181/0.05; 165/84

[56] References Cited

U.S. PATENT DOCUMENTS 1,814,554 7/1931 Hutchison .
1,984,542 12/1934 Olsson ..... 181/27
3,831,561 8/1974 Yamamoto et al. ..... 122/379
4,018,267 4/1977 Tomosichio ..... 122/379
4,120,699 10/1978 Kennedy, Jr. et al. ..... 165/84
4,359,962 11/1982 Olsson ..... 181/0.5

FOREIGN PATENT DOCUMENTS 2822680 12/1978 Fed. Rep. of Germany .
WO82/3803 11/1982 PCT Int'l Appl. .

*Primary Examiner*—Henry C. Yuen
*Attorney, Agent, or Firm*—Finnegann, Henderson, Farabow, Garrett & Dunner

[57] ABSTRACT

An infrasound generator including a quarterwave resonator tube having a closed end and an open end and being of substantially uniform diameter, the open end of the tube being adapted to communicate with a space containing the heat exchange surfaces of a boiler through an aperture in a wall of the space and having means for supplying pulsating pressurized air to the closed end of the resonator tube. An outwardly opening conical diffuser is connected between the open end of the resonator tube and the space and a sleeve extends back from the wall and surrounds at least a portion of the length of the tube, the sleeve being of greater diameter than the tube with resilient closure means connected between the diffuser and the sleeve.

7 Claims, 5 Drawing Figures

INFRASOUND GENERATOR

Figure 1:
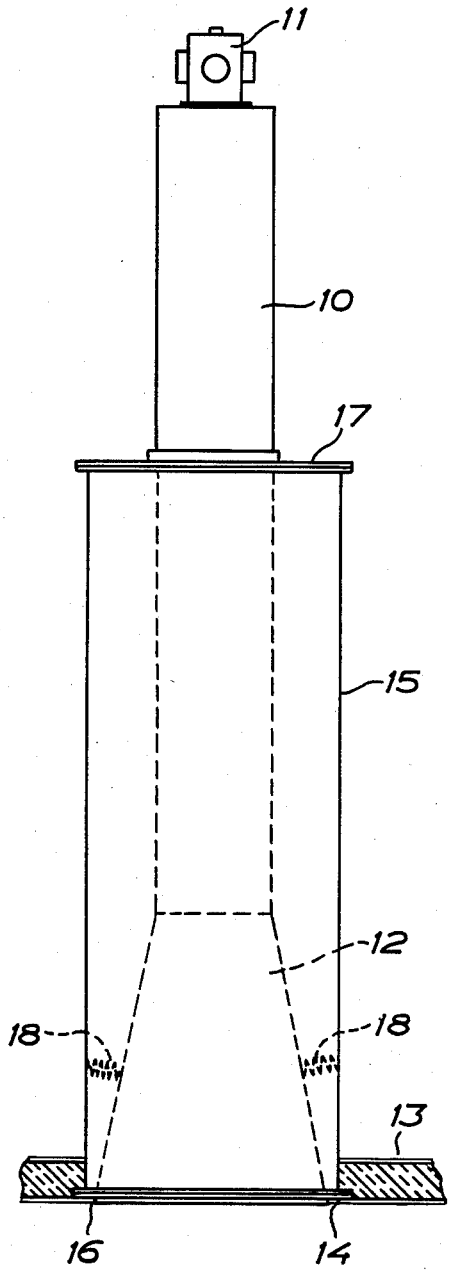

This application is a continuation of application Ser. No. 712,007, filed Mar. 15, 1985; now abandoned which is a continuation-in-part of application Ser. No. 649,957, filed Sept. 11, 1984 and now abandoned; which is a continuation of application Ser. No. 588,050, filed Mar. 9, 1984 and now abandoned; which is a continuation of application Ser. No., 457,071, filed Dec. 29, 1982 and now abandoned.

The infrasound generator includes a quarterwave resonator tube having a closed end and an open end and of substantially uniform diameter, in which the open end of the tube is adapted to communicate with a space containing the heat exchange surfaces of a boiler through an aperture in a wall of the space, and having means for supplying pulsating pressurized air to the closed end of the resonator tube.

When infrasound is used for sooting large industrial boilers and equipment for industrial boilers such as economizers and air preheaters, it has been found that the required acoustic power is of the order of 100 W or more. In the generation of high acoustic power at low frequencies it is always necessary to use some type of resonator. A tube resonator of the quarter-wave type has been found to be particularly suitable. Such a resonator has a length which corresponds to one forth of the wave length of the sound to be generated. When sound of the frequency 20 Hz is being generated, the wave length in air of room temperature is 340/20=17 m and accordingly the length of the resonator tube then will be about 4 m.

In the opening of the resonator tube, the air movement is at maximum. Deeper in the resonator tube, the amplitude of the air movement decreases. However, the sound pressure is at maximum at the closed end of the resonator tube and decreases with increasing distance from the closed end. The losses in the sound generator to a great extent consist of flow losses at the oscillation of the air at the open end. In order to minimize this loss the open end of the resonator tube should be sufficiently large.

One method of generating high acoustic power is to feed pulses of pressurized air into the closed end of the resonator tube. The power developed by the pulses of pressurized air is determined by the product of the flow of pressurized air and the pressure encountered by the pulses of pressurized air, viz. the sound pressure at the closed end of the resonator tube. The sound pressure in the resonator tube is dependent on the diameter of the resonator tube. At a large diameter at the closed end the sound pressure will be low for which must be compensated by a large flow of pressurized air. At a small diameter the sound pressure will be high. However, in practical constructions, the amplitude of the sound pressure at the closed end must be less than the atmospheric pressure.

In order to obtain optimum conditions the resonator tube accordingly should have different diameters at the open and closed ends, respectively. When acoustic power of the order of 100 W or more is to be generated it has proved suitable to choose a diameter at the open end of the resonator tube of about 0,8 m and a diameter at the closed end of about 0,4 m. This difference in diameters can be obtained by providing a conical resonator tube. However, having conical form the resonator tube must be made longer than a cylindrical tube at the same frequency of the sound to be generated. Moreover, a conical tube is unpractical considering manufacture as well as mounting.

One solution of the problem is to make the resonator tube cylindrical with the diameter which is the optimum diameter considering the conditions at the closed end, and to provide the tube with a diffuser at the open end. A conical diffuser provides a good function and is simple to manufacture. E.g. at a diameter of 0.4 m of the resonator tube, a conical diffuser having the length of 1 m and the opening diameter of 0.8 m is suitable. In some cases it may be desired (due to lack of space) to have a smaller diffuser. However, the conical diffuser should not have a conicity which is too large.

The primary purpose of the invention is to provide an arrangement in an infrasound generator of the kind referred to above which makes possible to combine with the space containing the heat exchanger surfaces, a resonator tube which by utilization of the diffuser effect described provides optimum conditions as to the generation of sound in the space.

Another purpose of the invention is to mechanically insulate the sound generator from the boiler construction so as not to transfer vibrations of the resonator tube directly to the boiler construction.

These and other purposes of the invention, which will be apparent from the description which follows, are achieved according to the invention by the improvement in an infrasound generator of the kind referred to above, comprising an outwardly opening conical diffuser connected between the open end of the substantially uniform diameter portion of the resonator tube and the space, a sleeve extending back from the wall and surrounding at least a portion of the length of the tube, the sleeve being of greater diameter than the tube, and resilient closure means connected between the diffuser and the sleeve.

Figure 2:
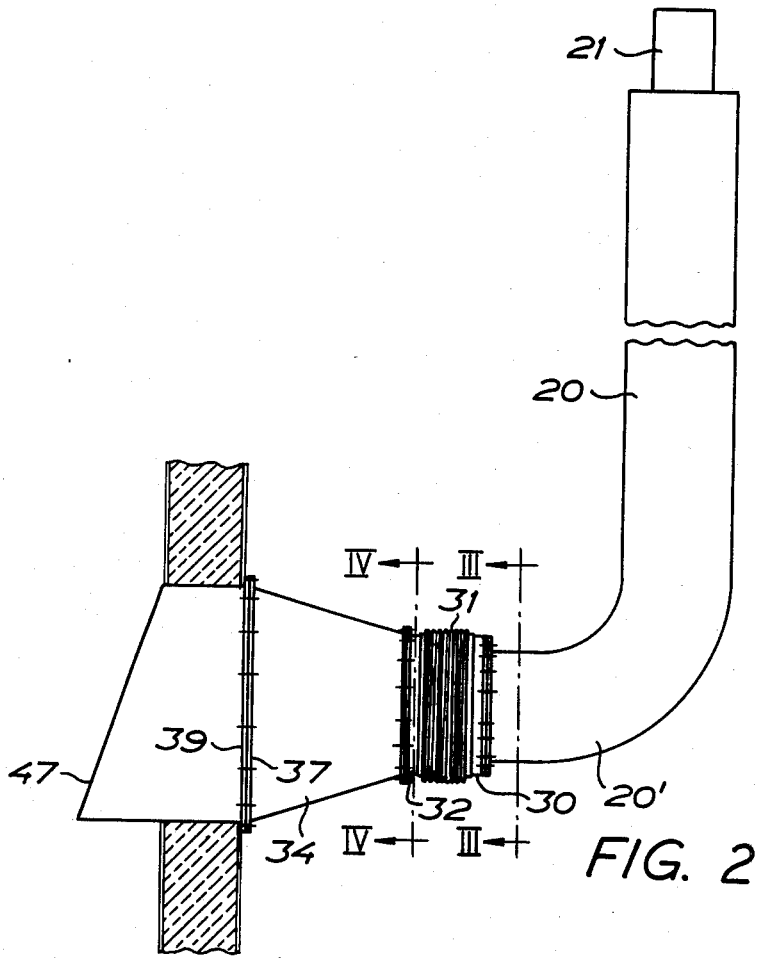
Figure 3:
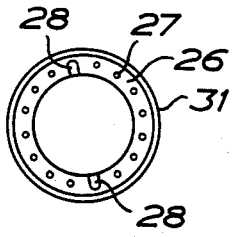
Figure 4:
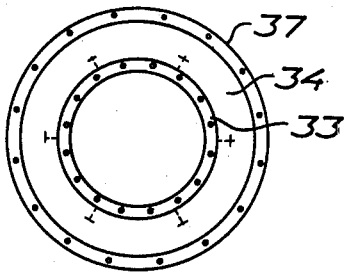
Figure 5:
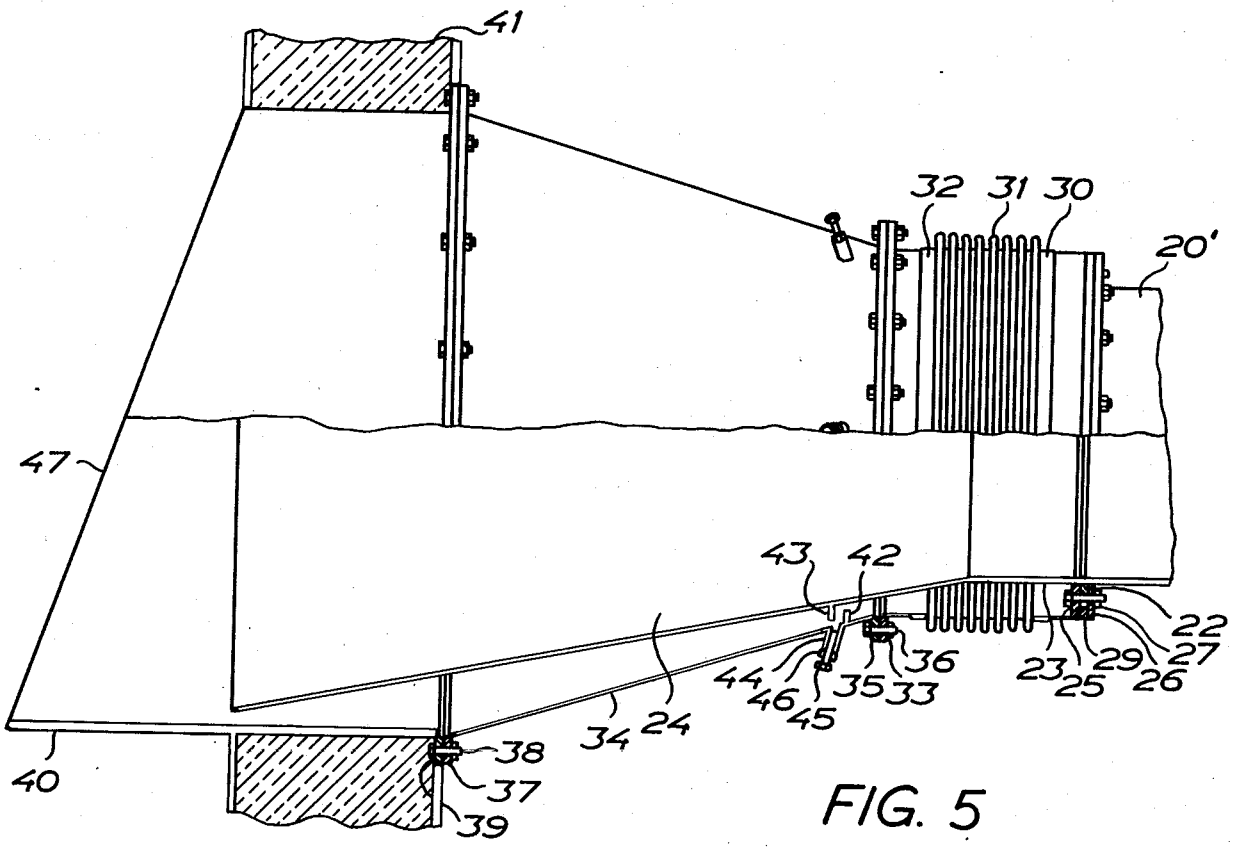

In order to explain the invention embodiments thereof will be described in more detail below with reference to the accompanying drawings in which FIG. 1 is a side view of an infrasound generator of the invention in one embodiment thereof, mounted to a boiler wall, FIG. 2 is a side view of an infrasound generator of the invention in another embodiment thereof, FIG. 3 is a cross sectional view taken along line III—III in FIG. 2, FIG. 4 is a cross sectional view taken along line IV—IV in FIG. 2, and FIG. 5 is an enlarged side view and partly a longitudinal cross sectional view taken along line V—V in FIG. 2, of the forward end portion of the sound generator of FIG. 2.

The infrasound generator can be of the type which is described in U.S. Pat. No. 4,359,962 issued Nov. 23, 1982.

Referring to FIG. 1 the infrasound generator comprises a cylindrical resonator tube 10 which is closed at one end thereof and at said end is provided with an exigator 11 including valve means for the supply of pulses of pressurized air. The resonator tube is provided with a conical diffuser 12 at the other end thereof. The resonator tube and the diffuser are dimensioned for the desired frequency and power as described above.

The sound generator is mounted on a boiler wall 13 which may be a top wall or a side wall, the diffuser 12 being inserted into an aperture 14 in the wall such that the open end of the resonator tube communicates with the interior of the boiler (the furnace) and the opening of the diffuser is substantially flush with the inner surface of the boiler wall.

The sound generator is mounted by means of a cylindrical socket or tunnel 15 which is connected at a flange 16 with the marginal portion of the aperture 14 and projects outwardly from the boiler wall 13. The tunnel has an inner diameter which is sufficiently large to allow the diffuser to be slid therethrough, and thus surrounds the rest of the resonator tube with an annular space between the outside of the resonator tube and the inside of the tunnel. The resonator tube is resiliently suspended in the tunnel by means of an annular diaphragm 17 of steel sheet, which has a thickness of some millimeters and is sealingly mounted at the outer end of the tunnel, the diaphragm being connected at the outer periphery thereof to the tunnel and at the inner periphery thereof to the resonator tube.

The resonator tube and the diaphragm form a resilient system which has a natural frequency that should be considerably higher than the frequency of the sound generator such that a fraction only of the mass forces from the vibrations of the resonator tube is propagated to the boiler via the tunnel.

Referring now to FIGS. 2–5, the infrasound generator shown therein comprises a resonator tube 20 mounted in a vertical position by means not shown in the drawings. The resonator tube has an exigator 21 at the closed end thereof and forms an end portion 20' which is angled 90° from the rest of the resonator tube. At the open end formed by portion 20' an annular flange 22 is fixedly connected to the tube 20. A diffusor comprises a cylindrical portion 23 having the same inside and outside diameter as the resonator tube, and a conical portion 24 and is connected to the resonator tube by a flange 25 fixedly connected to the cylindrical portion, which is connected to the flange 22 on the resonator tube with a ring 26 located inwardly of the flange 22. The ring 26 comprises two identical halves to allow dismounting from the resonator tube 20. The flanges and the ring are clamped together by means of bolt and nut connections 27 equally spaced around the circumference of the flanges. However, two or more recesses 28, FIG. 3, are formed in the ring 26 such that the bolt and nut connections at said recesses interconnect the two flanges directly without the intermediary of the ring. The outer diameter of the flange 22 is smaller than the outer diameter of the flange 25 and the ring 26 so that there is formed by the flanges and the ring a circumferential annular groove between flange 25 and ring 26. A ring 29 surrounding flange 22 is located between flange 25 and ring 26. Rotation of ring 29 is possible when all bolts in ring 25 except the two bolts in the recesses 28 are loosened.

An annular end piece 30 of steel bellows 31 is fixedly connected to the ring 26 at the outer periphery thereof, and an opposite annular end piece 32 of the bellows is fixedly connected to an annular flange 33 at the inner periphery thereof. A conical sleeve 34 is provided with an end flange 35 at the small end thereof and is connected at said flange to the flange 33 by means of bolt and nut connections 36 equally spaced around the periphery of the flange. The large end of the conical socket 34 is provided with a flange 37, which is connected by bolt and nut connections 38 equally spaced around the flange, to a flange 39 provided at one end of a cylindrical sleeve 40 which is fixedly mounted in an opening in a boiler wall fragmentarily indicated at 41. Thus it will be seen that the major part of the diffuser of the sound generator is received by the combined sleeve 34, 40 which is closed against the surrounding by means of the bellows arrangement described.

In the circumferential space left between the diffuser and the surrounding conical sleeve 34 there are provided two annular flanges one of which designated 42 is fixedly secured to the sleeve 34, and the other one of which designated 43, is fixedly secured to the diffuser portion 24, the two flanges being axially spaced to form a labyrinth seal. Hollow studs 44 are connected to the outside surface of the conical sleeve 34 and are equally spaced around the circumference of the socket, and in each stud a screw 45 can be screwed into the socket in an acute angle against the flange 43. A lock nut 46 is provided on the screw.

The bellows 31 is very weak in the axial direction thereof and should be sufficiently weak in the radial direction so as to insulate vibrations of the resonator tube 20, generated when the infrasound generator is in operation, from the boiler construction. However, the bellows should be about 10 times more rigid in the radial direction because if the bellows is too weak in the radial direction there may arise difficulties in stabilizing the bellows in the mounted position.

The possibility of relative rotation between the bellows and the resonator tube at the ring 29 allows the resonator to be mounted in the desired position independently of the bellows and also allows thermally initiated movements as may occur between the boiler and the resonator suspension. After adjustment the bolts in ring 26 are tightened.

The sleeve which is connected to the boiler and receives the diffuser in this embodiment includes the conical portion 34 in order to minimize the deposition of ash, and the cylindrical portion 35 in order to facilitate the mounting of the combined sleeve to the boiler wall. However, in order to still more effectively prevent ash particles from reaching the bellows and collecting therein the labyrinth seal has been provided. This seal has a further function, namely to form a complete closure between the interior of the boiler and the surroundings when it is necessary to replace the bellows. When this has to be done the bellows is extended outwards by partly withdrawing the diffuser from the boiler sleeve such that the annular flange 43 is engaged with the annular flange 42. When the flanges are in this position, the screws 45 are screwed into the studs 44 to be set against the flange 43 engaging the flange 42 in order to lock the flanges in this postion. Then, the bellows is disconnected from the flange 35 and also from the flange 22 by dismounting the ring 26, the diffuser being still connected to the resonator tube by the bolt and nut connections in the recesses 28. When this has been done the bellows can be withdrawn and can be removed completely from the resonator tube by cutting the bellows axially at one or more locations at the circumference thereof. A spare bellows may be stored on the resonator tube so as to be moved into operative position and connected to the sleeve and the resonator tube in the manner shown and described.

Preferably, the flanges 42 and 43 should be in the engaged position locked by means of the screws 45 during transport of the infrasound generator with the socket assembly mounted to the generator, so as to protect the bellows from movements during the transport, which may be hazardeous to the bellows.

The sleeve 40 is cut at an angle as shown at 47. The angle preferably is not greater than 30°. By this arrangement the sleeve can be mounted in an inclined position without the necessity of welding a supplementary portion to the sleeve. The inner end of the sleeve should be cut along the inner surface of the wall 41.

I claim:

1. In an infrasound generator including a quarter-wave resonator tube having a closed end and an open end and of substantially uniform diameter, in which the open end of the tube is adapted to communicate with a space containing the heat exchange surfaces of a boiler through an aperture in a wall of the space, and having means for supplying pulsating pressurized air to the closed end of the resonator tube, the improvement comprising an outwardly opening conical diffuser connected between the open end of the substantially uniform diameter portion of the resonator tube and the space, a sleeve extending back from the wall and surrounding at least a portion of the length of the tube, the sleeve being of greater diameter than the tube, and resilient closure means connected between the diffuser and the sleeve.

2. The infrasound generator of claim 2 wherein said resilient means comprises an elastic annular diaphragm connected at its inner periphery to the resonator tube and at its outer periphery to the sleeve.

3. The infrasound generator of claim 1 wherein the sleeve is substantially flush with the inside surface of said wall.

4. The infrasound generator of claim 1 wherein a bellows surrounding the resonator tube is connected between the outer end of the sleeve and a flange on the resonator tube.

5. The infrasound generator of claim 4 wherein the bellows is rotatably mounted to the flange.

6. The infrasound generator of claim 4 wherein flanges on the inner surface of the sleeve and the outer surface of the diffuser form a labyrinth seal.

7. The infrasound generator of claim 6 wherein the flanges forming the labyrinth seal are mounted to be engaged with each other by extension of the bellows and wherein means are provided for locking the flanges in the engaged position.

* * * * *